United States Patent [19]

Raab

[11] Patent Number: 4,986,089

[45] Date of Patent: Jan. 22, 1991

[54] ADJUSTABLE REFRIGERATABLE BEVERAGE WRAP AROUND HOLDER

[75] Inventor: Reginald S. Raab, Middleville, Mich.

[73] Assignee: Big Chill, Inc., Grand Rapids, Mich.

[21] Appl. No.: 391,979

[22] Filed: Aug. 10, 1989

[51] Int. Cl.[5] ..... F25D 3/08

[52] U.S. Cl. ..... 62/457.4; 428/100; 428/913; 220/903

[58] Field of Search ..... 428/76, 100, 102, 192; 220/903, 400; 62/457.4

[56] References Cited

U.S. PATENT DOCUMENTS

| | | | |
|---|---|---|---|
| 3,813,801 | 6/1974 | Schaaf | 220/903 |
| 4,399,668 | 8/1983 | Williamson | 220/903 |
| 4,831,842 | 5/1989 | Kelley et al. | 62/457.4 |

*Primary Examiner*—Alexander S. Thomas

*Attorney, Agent, or Firm*—Harness, Dickey & Pierce

[57] ABSTRACT

An adjustable refrigeratable holder for insulating and chilling a beverage container. More particularly a beverage container holder which circumferentially encloses the beverage container and including a plurality of individually disposed freezable masses consecutively positioned along an exterior layer of insulative material. The freezable masses forming an inner diameter for receiving the exterior walls of a beverage container. When frozen, the freezable masses will absorb heat from the beverage and container and thus cause the beverage to remain chilled for an extended period of time or, when the beverage is warmer than the freezable masses, become chilled. A rectangular strip of insulative material helps to secure the freezable masses and also forms an insulative barrier along the top and bottom of the beverage container between the ambient temperatures and both the freezable masses and the main body of the beverage container.

3 Claims, 1 Drawing Sheet

ADJUSTABLE REFRIGERATABLE BEVERAGE WRAP AROUND HOLDER

BACKGROUND OF THE INVENTION

The invention relates to a refrigeratable beverage wrap around holder, and more particularly to a refrigeratable beverage wrap around holder constructed with a patched network of reusable refrigerant, such as "Blue Ice", surrounded by a layer of neoprene rubber, commonly used as an insulating material in wet suits. The reusable refrigerant is comprised of water in a gelatenous state. This gelatenous state is produced by adding a viscosity increasing agent, a methylcellulose composition, to the water. Attached to one end of the interior surface of the neoprene rubber and to the opposite end of the exterior surface of the neoprene rubber is a strip of hook and loop fastener, such as "Velcro", used as a fastener. The Velcro is then used to fasten the holder around canned or bottled beverages of various sizes. Once circumferentially enclosing the beverage container, the invention maintains the beverage at the proper chilled temperature and, in some situations, further chills the beverage.

A considerable number of canned and bottled beverages are intended to be consumed in a chilled state and are more readily enjoyed by the consumer public when consumed in such a chilled state. While these beverages are often bought chilled, many are bought while at room temperature and must be chilled by the consumer prior to consumption. The chilling of the beverage is most often accomplished by storing the canned or bottle beverage in a refrigerator or ice filled chest until the beverage reaches the desired temperature. This is particularly true for such beverages as soft drinks, beer, wine and juice.

Modern refrigerators are generally kept at a temperature above that considered ideal for the consumption of many of these beverages. Lower temperatures can be achieved by utilizing a household freezer or an ice filled chest. The freezer method proves to be impracticable due to the possibility of a beverage freezing and rupturing the beverage container during extended storage time in the freezer. The ice filled chest also proves impracticable because of a continuous need of additional ice in the chest. A direct result of these problems is that many beverages are consumed at less than ideal temperatures.

The problem is compounded by the fact that many of these beverages are consumed outdoors during the warmer months of the year. In order to compensate for the absorption of heat by the beverage from the environment, many of these beverages are transferred into containers filled with ice. While this retards heat absorption by the beverage, the melting ice dilutes the beverage and alters the taste. In some beverages, soft drinks, this has been acceptable. In others, beer, it has not.

To eliminate the diluting of the beverage while attempting to maintain a chilled temperature, prior art discloses the development of the insulating beverage container holder. Such insulating holders are generally constructed of a foam material such as foamed polystyrene or other open or closed cell foam materials. The beverage holder's configuration is generally that of a cup capable of receiving the beverage and its container centrally inside. Common variations on the insulative cup include those with a plastic ring located on the top of the insulative cup allowing the beverage container to be placed inside creating a dead air space therearound. Another variation is a soft foam insulating cup having an inside diameter slightly less than the beverage container's, thus providing direct contact between the insulative cup and the beverage container. A third variation of the beverage insulator holder is one which wraps circumferentially around the beverage container and connects to itself by means of some common fastener. This variation is often called the wrap around holder.

Several limitations exist with the prior art. The beverage container must be chilled prior to being placed inside any of the insulative holders. Upon being removed from its refrigerated environment, the beverage and beverage container can only increase in temperature. Thus, the insulative holder only compensates for the high thermal conductivity of the beverage container by slowing down this inevitable warming trend.

Next in the evocation of the insulative beverage holder came the refrigeratable beverage holder. Prior art has provided refrigeratable beverage holders in various embodiments. Early embodiments were heavy, expensive and cumbersome. One such embodiment is the mug-shaped device shown and described in U.S. Pat. No. 3,302,428 issued on Feb. 7, 1977. U.S. Pat. No. 4,163,374 issued on Aug. 7, 1979, shows and describes a refrigeratable beverage container holder that overcomes the awkwardness and weight problems of the previously mentioned patent. However, it too has limitations and presents additional problems.

One limitation of the aforementioned prior art is its inability to adjust and accept beverage containers of any considerably varying size. A second limitation of the prior art is the amount of storage space it requires. The usable area inside of today's refrigerator is limited. This being the case, the rigid stand-up design of the prior art, being substantially larger in diameter than the beverage container itself, proves to be bulky and excessively space consuming during refrigerated storage. If more than one prior art beverage holder is to be stored, ready for use, in the refrigerator, the problem concerning storage space becomes increasingly aggravated.

The adjustable, refrigeratable, wrap around beverage container holder of the present invention overcomes the limitations and problems of the prior art refrigeratable beverage holders. While overcoming these problems and limitations, the present invention maintains the chilled condition of the beverage and, in some situations, actually chills the beverage before and during consumption. The present invention overcomes the limitations of prior art refrigeratable beverage holders by providing the means within a refrigeratable insulated beverage container holder to adjust and accept beverage containers of substantially varying size while being capable of occupying minimal space during refrigerated storage. In addition, the present invention is also capable of utilizing the high thermal conductivity characteristic of the modern beverage container to maintain the beverage at its chilled temperature for as long a time period as possible. When a beverage container received into the present invention is at a temperature greater than that of the present invention, the present invention functions as a heat sink and chills the beverage.

Additional benefits and advantages of the present invention will become apparent to those skilled in the art to which this invention relates from the subsequent description of the preferred embodiments and the appended claims, taken in conjunction with the accompanying drawings.

SUMMARY OF THE INVENTION

The invention relates to an adjustable refrigeratable beverage container holder (hereinafter the holder) which includes a number of individual packets of reusable refrigerant for cooling and maintaining a beverage below ambient temperatures when the beverage container is placed within the invention. In particular, the improvement comprises reusable refrigerant, such as water in a gelatenous suspension, disposed within individual plastic containers or packets. The reusable refrigerant is of the type which forms a solid state at temperatures at or below freezing and viscous fluid state at temperatures above freezing. In so doing, it is possible to use the latent heat of fusion of the reusable refrigerant to effectively absorb heat from a beverage and beverage container received within the holder.

The improvement comprises a holder of the type including a wrap around outer belt of insulative material. The belt is comprised of an insulative foam material with common fastener attached to a portion of one end and a portion of the opposite end. Such a fastener allows the belt to circumferentially engage various diameter beverage containers by connecting and overlapping the belt's ends. In particular, the holder includes strips of the hook and loop fastener "Velcro", as a common fastener, attached to the inside surface of one end of the belt and to the outside surface of the belt's opposite end. The belt is a layer of the insulative material commonly used in wet suits, neoprene rubber. A layer of closed cell nylon is laminated to the outside surface of the neoprene rubber for visual enhancement of the product.

A further aspect of the invention is a heat absorbing means consisting of individually disposed freezable masses of reusable refrigerant. The reusable refrigerant consists of water in a gelatenous state. The gelatenous state is produced by the addition of a viscosity increasing agent to the water. Cornstarch or a methylcellulose composition is used as the viscosity increasing agent. The reusable refrigerant is packaged in individual plastic containers or packets of a generally pillow shape. Once filled with an ample amount of reusable refrigerant, the packets are thermally sealed to prohibit the relatively viscous reusable refrigerant from leaking out of the packet. Various alternative methods can be employed to seal the reusable refrigerant in the packets, including pressure and adhesive sealing.

Extending from each end of the packet is a flange region having a length about equal to the width of the packet. The flange regions enable the packet to be attached to the inside surface of the belt. The individual packets are positioned at periodic intervals throughout the length of the belt in such a manner as to allow the flange regions of the packets to be attached to the lengthwise edges of the belt. The attachment can be accomplished by various methods. Use of an adhesive, such as ethyl cranoacrylate, is particularly desirable because of the adhesive's durability, water resistance and workability with the numerous construction materials.

Positioning the individual packets of reusable refrigerant as such, the invention is capable of flat refrigerator or freezer storage. The flat position enables the invention to conserve storage space in the limited confines of a home refrigerator or freezer. While in the flat storage position, the reusable refrigerant is allowed to freeze. If freezer space considerations do not allow for freezer storage of the invention, the reusable refrigerant is alternatively allowed to cool to a temperature near freezing.

Once frozen, the periodic positioning of the individual containers permits the holder to be readily bent at positions between the containers to thereby enable the holder to adjust from a flat storage position, even with the refrigerant now frozen solid, to a generally annular shape and to circumferentially enclose various diameter and shaped beverage containers. Once in contact with the walls of the beverage container, the frozen refrigerant acts as a heat sink for the beverage and thereby cools or maintains the chilled temperature of the beverage.

Still another aspect of the invention includes a rectangular strip of neoprene rubber attached along the interior surface of each lengthwise edge of the belt, but somewhat shorter in length. One end of each rectangular strip is affixed to the interior surface of the end of the belt having the common fastener attached to its outside surface. The opposite end of each rectangular strip is attached to the inside surface of the opposite end of the belt, at a position recessed from that area occupied by the common fastener also there attached.

The rectangular strips further secure the individual containers by attaching to the extended flange regions of the containers of reusable refrigerant. The flange regions are thus positioned within the space between the adjacent lengthwise edges of the outer belt and inner rectangular strips of neoprene rubber.

Laminated to the interior surface of the rectangular strips is a rectangular strip of closed cell nylon, having dimensions corresponding to the rectangular strip of neoprene rubber, for visual enhancement of the product. When a beverage container is centrally received into the holder, the rectangular strip of neoprene rubber circumferentially engages the upper and lower portions of the exterior wall of the beverage container.

Once in contact with the beverage container, the rectangular strips of neoprene rubber create a gasket-like barrier for insulating the containers of frozen refrigerant and the exterior wall of the beverage container from the ambient temperature. Thus, the rectangular strips assist the frozen refrigerant in chilling the beverage and retarding the absorption of heat by the beverage.

Further objects, features and advantages of the invention will become apparent from a consideration of the following description and the appended claims when taken in connection with the accompanying drawings.

DETAILED DESCRIPTION OF THE DRAWINGS

Figure 1:
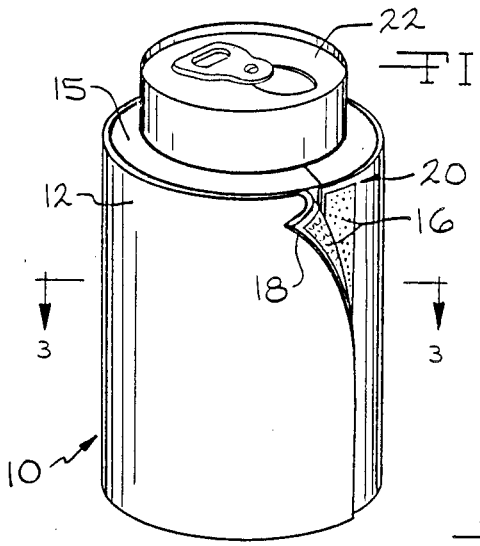
FIG. 1 is a perspective view of an adjustable refrigeratable beverage container holder, constructed in accordance with the principles of the present invention, circumferentially engaging a beverage container.

Referring first to FIG. 1, shown is a perspective view of adjustable refrigeratable beverage container holder 10 (hereinafter holder 10) constructed in accordance with the principles of the present invention. Holder 10 is formed with outer belt 12 being made of a highly insulative material, such as neoprene rubber. Attached along the lengthwise edges of the interior surface 18 of belt 12 is upper rectangular strip 15 and lower rectangular strip 14, also composed of the highly insulative material neoprene rubber. Strips of hook and loop fastener 16, a common fastener, are attached along interior surface 18 of one end of belt 12 and along exterior surface 20 of the opposite end of belt 12. Beverage container 22 is circumferentially enclosed by wrapping holder 10 around beverage container 22 and connecting hook and loop fastener 16. The inner diameter of holder 10, created by the connecting of hook and loop fastener 16 and caused by holder 10 taking a generally annular shape, will about equal the diameter of beverage container 22. Upper rectangular strip 15 and lower rectangular strip 14 will circumferentially engage the exterior wall of beverage container 22 and create an insulative barrier between the surrounding conditions and the body of beverage container 22.

Figure 2:
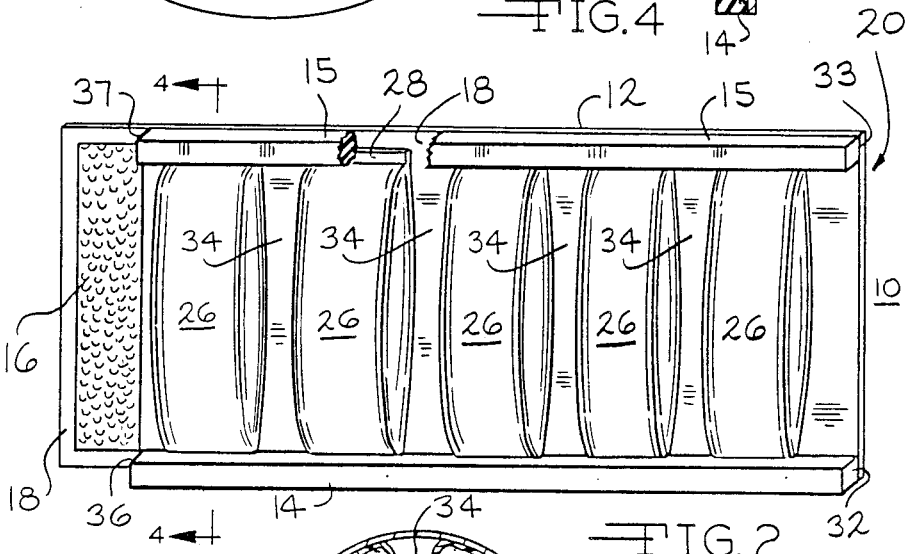
FIG. 2 is a partially cut away perspective view of an adjustable refrigeratable beverage container holder constructed in accordance with the principles of the present invention.

Referring now to FIG. 2, holder 10 is shown in a partially cut away perspective view while being disengaged from beverage container 22. This is also the flat freezer or refrigerator storage position of holder 10. Strips of hook and loop fastener 16 are attached to the interior surface 18 of one end of belt 12 and to exterior surface 20 of the opposite end of belt 12.

Figure 3:
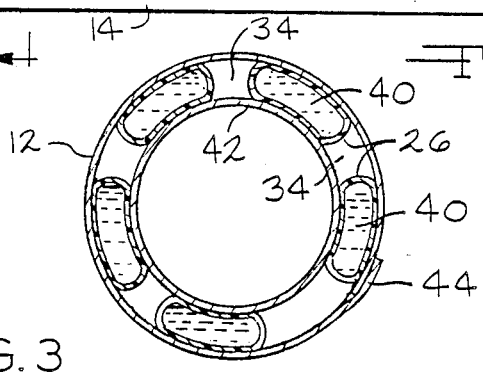
FIG. 3 is a cross sectional view taken along lines 3—3 in FIG. 1 of a adjustable refrigeratable beverage container holder, constructed in accordance with the principles of the present invention, circumferentially engaging a beverage container.

The heat absorbing means in holder 10 is comprised of a reusable refrigerant 40 disposed within a number of individual thin walled containers 26. Thin walled containers 26 are consecutively positioned along interior surface 18 of belt 12 so as to circumferentially enclose beverage container 22 when holder 10 is in a generally annular shape, as shown in FIGS. 1 and 3. Five thin walled containers 26 are shown in FIGS. 1 and 3, however, less than five, and six or more can also be used.

Open areas 34 are located between each thin walled container 26. Open areas 34 permit holder 10 to be formed in a generally annular shape and adjust to various diameter beverage containers when reusable refrigerant 40 has been frozen during flat storage in some type of freezer. Thin walled containers 26 are generally pillow-shaped and constructed from plastic sheeting being thermally sealed along the edges. The thermal seals are to prevent the leakage of reusable refrigerant 40. Other methods, including adhesive and pressure sealing, could alternatively be used.

Extending in a lengthwise direction from each thermally sealed end of thin walled container 26 are flange regions 28. Flange regions 28 enable thin walled container 26 to be attached between interior surface 18 of belt 12 and rectangular strips 14 and 15. Ends 32 and 33 of rectangular strips 14 and 15 are attached to interior surface 18 of belt 12, at the end where a strip of hook and loop fastener 16 is attached to exterior surface 20 of belt 12. Rectangular strips 14 and 15 are attached to interior surface 18 along the corresponding lengthwise edges of belt 12. Rectangular strips 14 and 15 assist in securing flange regions 28 to interior surface 18 of belt 12. Remaining end 36 of rectangular strip 14 and remaining end 37 of rectangular strip 15 are attached to interior surface 18 of belt 12 at a position parallel to, but recessed from, the end of belt 12 where hook and loop fastener 16 is attached to interior surface 18 of belt 12.

FIG. 3 shows a cross sectional view take along lines 3—3 in FIG. 1 of holder 10 circumferentially engaging beverage container 22. Reusable refrigerant 40 is disposed within each thin walled container 26 (each only shown twice for clarity). Reusable refrigerant 40 is water, chemically treated with a viscosity increasing agent of cornstarch or of a methylcellulose composition to form a gelatenous state. Thin walled containers 26 are positioned along inner surface 18 of belt 12 so as to circumferentially enclose and come in contact with exterior wall 42 of beverage container 22. Open areas 34 between thin walled containers 26 permit holder 10 to be readily bent at open areas 34 and to form a generally annular shape when reusable refrigerant 40 is frozen while holder 10 is stored in the flat position. When the beverage and beverage container 22 are received into holder 10 at a temperature higher than that of reusable refrigerant 40, reusable refrigerant 40 functions as a heat sink and absorbs heat from the beverage through beverage container 22 and thin walled container 26 thereby maintaining the beverage at a chilled condition or chilling the beverage. End 32 and end 36 of rectangular strip 14, and corresponding ends 33 and 37 of rectangular strip 15, meet when the circumference of beverage container 22 and the length of rectangular strip 14 are about equal. Hook and loop fastener 16 overlaps and attached to itself 44 and secures holder 10 to beverage container 22. Holder 10 is also held securely to beverage container 22 by the coefficient of frictions between that part of thin walled container 26 and that part of rectangular strips 14 and 15 that are in contact With exterior wall 42 of beverage container 22.

Figure 4:
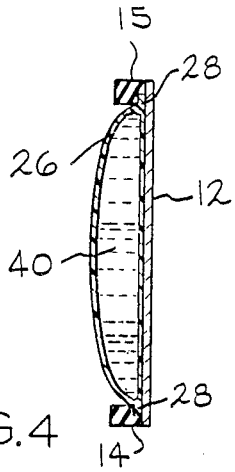
FIG. 4 is a cross sectional view taken along lines 4—4 in FIG. 2 of an adjustable refrigeratable beverage container holder constructed in accordance with the principles of the present invention.

FIG. 4 shows a cross sectional view along lines 4—4 of FIG. 2 of holder 10. Thin walled container 26 is attached to belt 12 through the use of adhesives, or some other attachment means, along flange regions 28. Flange regions 28 are further secured by the overlapping and attachment of rectangular strips 14 and 15 to the corresponding lengthwise edges of belt 12. The attachment of rectangular strips 14 and 15 is also accomplished through the use of adhesives or other attachment means. Reusable refrigerant 40 is dispensed within the body cavity of thin walled container 26.

While the above description constitutes the preferred embodiments of the present invention, it will be appreciated that the invention is susceptible to modification, variation and change without departing from the proper scope and fair meaning of the accompanying claims.

What is claimed is:

1. An adjustable refrigeratable beverage container holder for wrapping around the exterior of a beverage container for chilling or maintaining a beverage in a chilled state before and during consumption, the improvement comprising:

an outer belt of insulative material having an interior surface with longitudinal edges, said belt having fastening means enabling said holder to adjustably wrap and fasten circumferentially around beverage containers of varying sizes;

a network of individual packets being substantially rectangular and pillow in shape and having freezable fluid disposed therein, said packets being of plastic sheeting sealed at opposing ends to retain said freezable fluid therein and having flange regions extending integrally from said sealed ends, said flange regions being fixably attached to said longitudinal edges of said interior surface so as to position said packets periodically and transversely to the length of said belt in a side-by-side relation with intervening areas permitting said belt to bend at said areas and form a generally tubular enclosure for receiving said beverage container; and rectangular strips of insulative material being fixably attached over said flange regions to said longitudinal edges of said interior surface of said belt and retentively securing said packets between said belt and said rectangular strips, said rectangular strips and said packets being in surface to surface contact with said exterior of said beverage container to chill and insulate the contents thereof, said rectangular strips also insulating said packets from ambient temperatures when said holder is wrapped around said beverage container.

2. An adjustable refrigeratable beverage container holder as set forth in claim 1 wherein said flange regions are attached to said holder by adhesive.

3. An adjustable refrigeratable beverage container holder as set forth in claim 1 wherein said freezable fluid is water in a gelatenous state, said gelatenous state being produced by the addition of a viscosity increasing agent to said water.

* * * * *